US008197366B2

(12) United States Patent
Chauvin et al.

(10) Patent No.: US 8,197,366 B2
(45) Date of Patent: Jun. 12, 2012

(54) BALL BAT INCLUDING INTEGRAL BARREL FEATURES FOR REDUCING BBCOR

(75) Inventors: Dewey Chauvin, Simi Valley, CA (US); Ian Montgomery, Simi Valley, CA (US); Hsing-Yen Chuang, Simi Valley, CA (US); Gary Filice, Moorpark, CA (US); William Giannetti, Winnetka, CA (US)

(73) Assignee: Easton Sports, Inc., Van Nuys, CA (US)

( * ) Notice: Subject to any disclaimer, the term of this patent is extended or adjusted under 35 U.S.C. 154(b) by 56 days.

(21) Appl. No.: 12/624,056

(22) Filed: Nov. 23, 2009

(65) Prior Publication Data

US 2011/0124447 A1 May 26, 2011

(51) Int. Cl.
*A63B 59/06* (2006.01)

(52) U.S. Cl. ..... 473/566; 473/567

(58) Field of Classification Search ..... 473/457, 473/519, 520, 564–568
See application file for complete search history.

(56) References Cited

U.S. PATENT DOCUMENTS

| | | | |
|---|---|---|---|
| 2,099,521 | A | 11/1937 | Herkimer et al. |
| 3,703,290 | A | 11/1972 | Wilson |
| 3,727,295 | A | 4/1973 | Gildemeister |
| 3,729,196 | A | 4/1973 | Heald, Jr. |
| 3,801,098 | A | 4/1974 | Gildemeister |
| 3,830,496 | A | 8/1974 | Reizer |
| 3,876,204 | A | 4/1975 | Moore et al. |
| 3,880,423 | A | 4/1975 | Kreag |
| 3,921,978 | A | 11/1975 | Warren |
| 4,014,542 | A | 3/1977 | Tanikawa |
| 4,032,143 | A | 6/1977 | Mueller et al. |
| 4,056,267 | A | 11/1977 | Krieger |
| 4,079,936 | A | 3/1978 | Schachter |
| 4,343,467 | A | 8/1982 | Newcomb et al. |
| 4,348,247 | A | 9/1982 | Loyd et al. |
| 4,543,284 | A | 9/1985 | Baum |
| 4,746,117 | A | 5/1988 | Noble et al. |
| 4,907,800 | A | 3/1990 | Passamaneck et al. |
| 5,104,123 | A | 4/1992 | Okitsu et al. |
| 5,180,163 | A | 1/1993 | Lanctot et al. |
| 5,393,055 | A | 2/1995 | McKay, Jr. |
| 5,458,330 | A | 10/1995 | Baum |

(Continued)

OTHER PUBLICATIONS

United States Patent and Trademark Office, International Search Report and Written Opinion for PCT/US10/57487, mailed Feb. 7, 2011.

*Primary Examiner* — Mark Graham
(74) *Attorney, Agent, or Firm* — Perkins Coie LLP

(57) ABSTRACT

A ball bat includes a barrel having one or more integral features for selectively stiffening regions of the barrel. The barrel may include an indented region forming a rib projecting inwardly into the barrel. Alternatively, one or more inwardly projecting lips may be formed on adjoining barrel sections that are bonded, welded, or otherwise attached to each other, such that an integral, internal rib is formed in the barrel. The internal rib stiffens the barrel, thus reducing the barrel's BBCOR. One or more integral ribs may be provided at any desired barrel locations for selectively limiting the barrel's performance without appreciably increasing the moment of inertia of the ball bat. In another embodiment, a joint, to which two barrel sections are bonded, welded, or otherwise attached, includes an inwardly projecting member that stiffens the barrel, thus reducing the barrel's BBCOR.

9 Claims, 4 Drawing Sheets

U.S. PATENT DOCUMENTS

| | | | | |
|---|---|---|---|---|
| 5,533,723 | A | 7/1996 | Baum | |
| 5,575,722 | A | 11/1996 | Saia et al. | |
| 5,624,115 | A | 4/1997 | Baum | |
| 5,964,673 | A | 10/1999 | MacKay, Jr. | |
| 6,146,291 | A * | 11/2000 | Nydigger | 473/566 |
| 6,152,840 | A | 11/2000 | Baum | |
| 6,755,757 | B2 | 6/2004 | Sutherland | |
| 6,808,464 | B1 | 10/2004 | Nguyen | |
| 6,872,156 | B2 * | 3/2005 | Ogawa et al. | 473/567 |
| 7,320,653 | B2 | 1/2008 | Fitzgerald et al. | |
| 7,361,107 | B2 * | 4/2008 | Giannetti et al. | 473/567 |
| 7,442,135 | B2 * | 10/2008 | Giannetti et al. | 473/567 |
| 7,534,179 | B1 * | 5/2009 | Vasek et al. | 473/566 |
| 7,749,115 | B1 | 7/2010 | Cruz et al. | |
| 2003/0153416 | A1 * | 8/2003 | Anderson | 473/566 |
| 2005/0070384 | A1 | 3/2005 | Fitzgerald | |
| 2006/0252586 | A1 | 11/2006 | Nguyen | |
| 2007/0196619 | A1 | 8/2007 | Carter et al. | |
| 2007/0207882 | A1 | 9/2007 | Van Nguyen | |
| 2008/0058132 | A1 | 3/2008 | Nguyen | |
| 2008/0070726 | A1 * | 3/2008 | Watari et al. | 473/566 |
| 2009/0029810 | A1 | 1/2009 | Fitzgerald et al. | |
| 2009/0215560 | A1 * | 8/2009 | McNamee et al. | 473/567 |
| 2009/0280934 | A1 | 11/2009 | Watari | |
| 2010/0160095 | A1 | 6/2010 | Chauvin et al. | |

* cited by examiner

BALL BAT INCLUDING INTEGRAL BARREL FEATURES FOR REDUCING BBCOR

BACKGROUND

Baseball and softball governing bodies have imposed various bat performance limits over the years with the goal of regulating batted ball speeds. Each association generally independently develops various standards and methods to achieve a desired level of play. Bat designers typically comply with these performance standards by adjusting the performance, or bat-ball coefficient of restitution ("BBCOR"), of their bat barrels. Typical methods of controlling BBCOR include thickening the barrel wall of a hollow metal bat, or increasing the radial stiffness of a composite bat via the selection of specific materials and fiber angles. A composite bat's radial stiffness and fiber orientations are limited, however, by a given material thickness. The barrel walls in composite bats, therefore, may also be thickened to provide additional stiffness, which in turn limits BBCOR and barrel performance.

Thickening a barrel wall generally increases the bat's weight and, more importantly, it's "swing weight" or moment of inertia ("MOI"). MOI is the product of: (a) a mass, and (b) the square of the distance between the center of the mass and the point from which the mass is pivoted. Mathematically, this is expressed as follows:

$$MOI=\Sigma Mass\times(Distance)^2$$

Accordingly, the MOI dictates that it becomes increasingly difficult to swing a bat as the bat's mass increases or as the center of the bat's mass moves farther from the pivot point of the swing (i.e., farther from the batter's hands). Because thickening the barrel wall increases the bat's weight at a region relatively distal from the batter's hands, doing so also increases the bat's MOI. Thus, while thickening a barrel wall effectively stiffens the barrel and reduces its performance, the consequent increase in MOI is generally undesirable for batters.

SUMMARY

A ball bat includes a barrel having one or more integral features for selectively stiffening regions of the barrel. The barrel may include an indented region forming a rib projecting inwardly into the barrel. Alternatively, one or more inwardly projecting lips may be formed on adjoining barrel sections that are bonded, welded, or otherwise attached to each other, such that an integral, internal rib is formed in the barrel. The internal rib stiffens the barrel, thus reducing the barrel's BBCOR. One or more integral ribs may be provided at any desired barrel locations for selectively limiting the barrel's performance without appreciably increasing the moment of inertia of the ball bat. In another embodiment, a joint, to which two barrel sections are bonded, welded, or otherwise attached, includes an inwardly projecting member that stiffens the barrel, thus reducing the barrel's BBCOR.

Other features and advantages will appear hereinafter. The features described above can be used separately or together, or in various combinations of one or more of them.

BRIEF DESCRIPTION OF THE DRAWINGS

In the drawings, wherein the same reference number indicates the same element throughout the views.

DETAILED DESCRIPTION OF THE DRAWINGS

Various embodiments of the invention will now be described. The following description provides specific details for a thorough understanding and enabling description of these embodiments. One skilled in the art will understand, however, that the invention may be practiced without many of these details. Additionally, some well-known structures or functions may not be shown or described in detail so as to avoid unnecessarily obscuring the relevant description of the various embodiments.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list.

The embodiments described herein are directed to a ball bat having a limited bat-ball coefficient of restitution ("BBCOR"), or limited barrel performance, allowing the bat to perform within regulatory association performance limits. The National Collegiate Athletic Association ("NCAA"), for example, has proposed limiting a barrel's BBCOR to below 0.510 or below 0.500. Limiting of the BBCOR is preferably accomplished without appreciably increasing (or by decreasing) the ball bat's moment of inertia ("MOI").

Figure 1:
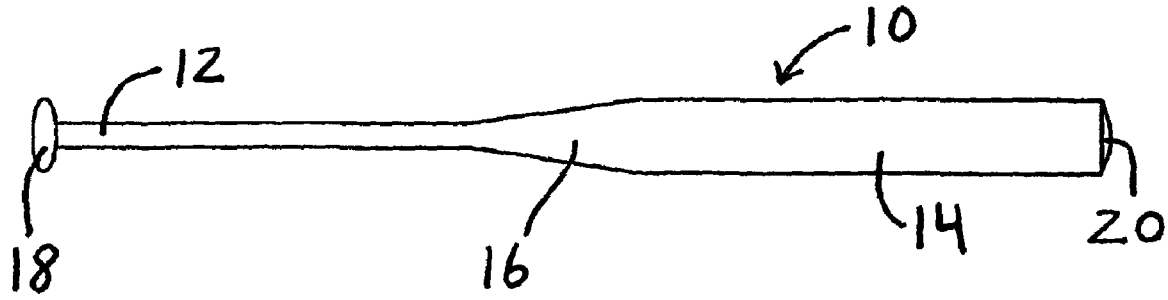
FIG. 1 is a perspective view of a ball bat, according to one embodiment.

Turning now in detail to the drawings, as shown in FIG. 1, a baseball or softball bat 10, hereinafter collectively referred to as a "ball bat" or "bat," includes a handle 12, a barrel 14, and a tapered section 16 joining the handle 12 to the barrel 14. The free end of the handle 12 includes a knob 18 or similar structure. The barrel 14 is preferably closed off by a suitable cap 20 or plug. The interior of the bat 10 is preferably hollow, allowing the bat 10 to be relatively lightweight so that ball players may generate substantial bat speed when swinging the bat 10. The ball bat 10 may be a one-piece construction or may include two or more separate attached pieces (e.g., a separate handle and barrel), as described, for example, in U.S. Pat. No. 5,593,158, which is incorporated herein by reference.

The ball bat 10 is preferably constructed from one or more composite or metallic materials. Some examples of suitable composite materials include fiber-reinforced glass, graphite, boron, carbon, aramid, ceramic, Kevlar, or Astroquartz®. Aluminum or another suitable metallic material may also be used to construct the ball bat 10. A ball bat including a combination of metallic and composite materials may also be constructed. For example, a ball bat having a metal barrel and a composite handle, or a composite barrel and a metal handle, may be used in the embodiments described herein.

The bat barrel 14 may include a single-wall or multi-wall construction. A multi-wall barrel may include, for example, barrel walls that are separated from one another by one or more interface shear control zones ("ISCZs"), as described in detail in U.S. Pat. No. 7,115,054, which is incorporated herein by reference. An ISCZ may include, for example, a disbonding layer or other element, mechanism, or space suitable for preventing transfer of shear stresses between neighboring barrel walls. A disbonding layer or other ISCZ preferably further prevents neighboring barrel walls from bonding to each other during curing of, and throughout the life of, the ball bat 10.

The ball bat 10 may have any suitable dimensions. The ball bat 10 may have an overall length of 20 to 40 inches, or 26 to 34 inches. The overall barrel diameter may be 2.0 to 3.0 inches, or 2.25 to 2.75 inches. Typical ball bats have diameters of 2.25, 2.625, or 2.75 inches. Bats having various combinations of these overall lengths and barrel diameters, or any other suitable dimensions, are contemplated herein. The specific preferred combination of bat dimensions is generally dictated by the user of the bat 10, and may vary greatly between users.

The ball striking area of the bat 10 typically extends throughout the length of the barrel 14, and may extend partially into the tapered section 16 of the bat 10. For ease of description, this striking area will generally be referred to as the "barrel" throughout the remainder of the description. A bat barrel 14 generally includes a maximum performance location or "sweet spot," which is the impact location where the transfer of energy from the bat 10 to a ball is maximal, while the transfer of energy to a player's hands is minimal. The sweet spot is generally located at the intersection of the bat's center of percussion (COP) and its first three fundamental nodes of vibration. This location, which is typically about 4 to 8 inches from the free end of the barrel 14, does not move when the bat is vibrating in its first (or fundamental) bending mode.

The barrel regions between the sweet spot and the free end of the barrel 14, and between the sweet spot and the tapered section 16 of the bat 10, do not provide the maximum performance that occurs at the sweet spot of the barrel 14. Indeed, in a typical ball bat, the barrel's performance, or trampoline effect, decreases as the impact location moves away from the sweet spot. Accordingly, the sweet spot generally requires the greatest limitation or reduction of BBCOR to bring the bat within regulatory association limits.

A variety of integral barrel features or configurations that reduce the barrel's BBCOR are described below. The specific type, size, and configuration of the one or more BBCOR-reducing features used in a given bat may be dictated by the performance limits of a given regulatory association, the weight and feel preferences of a given batter, and so forth. While it is generally preferred that BBCOR-reducing features be located at or near the sweet spot of the barrel 14, it may be preferable in some embodiments to locate the these features in other bat regions, such as closer to the handle 12 to limit the increase in MOI resulting from inclusion of the features. Thus, depending on the design goals for a particular bat, one or more of the following embodiments may be utilized at one or more locations of the ball bat 10.

Figure 2:
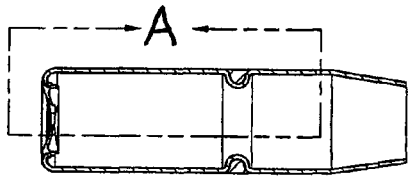
FIG. 2 is a side-sectional view of a bat barrel, according to one embodiment.
Figure 2A:
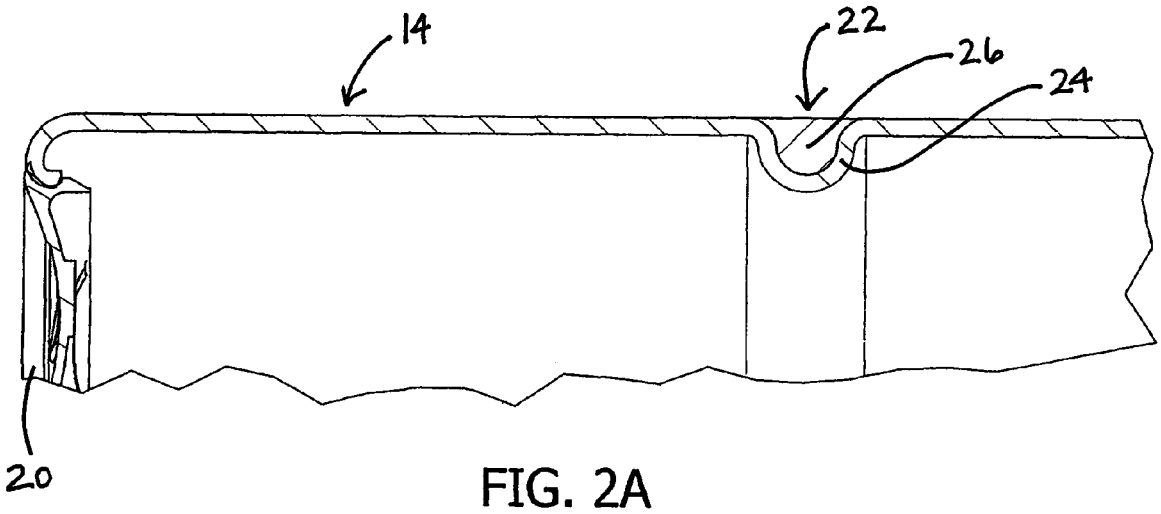
FIG. 2A is a magnified view of Section A of FIG. 2.

As shown in FIGS. 2 and 2A, in one embodiment, the barrel 14 includes a collapsed or indented region 22 that forms a channel around the circumference of the barrel 14. The indented region 22 is defined by an inwardly projecting portion of the barrel 14, which will be referred to as a rib 24. The indented region 22 may be formed in the barrel using a rolling apparatus, a crimp die, electro-magnetic forming equipment, or any other suitable device.

The inwardly projecting rib 24 stiffens the barrel 14 at the indented region 22, which reduces the barrel's BBCOR in that region, and, to a lesser extent, in longitudinally neighboring regions of the barrel 14. Accordingly, it is generally desirable to provide the inwardly projecting rib 24 at or near the barrel's sweet spot.

A filler material 26 is preferably included in the indented region 22 to form a continuous, flush exterior surface with longitudinally neighboring regions of the barrel 14. The filler material 26 may be glued, injected, pre-formed then glued, or otherwise suitably secured or adhered to the indented region 22 of a composite or metal ball bat. The filler material may also be co-cured with the barrel 14 of a composite ball bat.

A variety of materials may be used to fill the indented region 22. The selected material or materials are preferably lightweight and resistant to impact but any suitable filler materials may be used. In one embodiment, the indented region 22 is filled with a thermoplastic material, such as Surlyn® or thermoplastic polyurethane ("TPU"). These materials provide suitable abrasion resistance and cosmetic flexibility.

Other materials, such as polyurethane foam (preferably covered with a coating or skin to provide abrasion resistance), epoxy foam, elastomeric materials, polypropylene, polyethylene, nylon, polycarbonate, Lexan®, silicone, and so forth, may be used as the filler material 26. Elastomeric materials, for example, allow for easy assembly as they can be premolded and then stretched over the barrel 14 and positioned in the indented region 22. In another embodiment, a ring of material, such as polypropylene, polyethylene, nylon, polycarbonate, Lexan®, TPU, silicone, or rubber, could be injection molded in place in the indented region 22.

If an elastomeric material is used as the filler material 26, the impact of such a material on the barrel's BBCOR must be considered. Many elastomeric materials (and similar materials) have a relatively high COR, which could limit the overall BBCOR-reducing effect of the inwardly projecting rib 24. The thickness or width of the filler material 26 may be limited to control the BBCOR. In one embodiment, for example, a 0.625 inch wide by 0.25 inch deep indented region 22 may provide a BBCOR of less than 0.50 if a filler material having of COR of less than 0.8 is used. The width and depth of the indented region 22 may of course be modified to allow a material having a higher or lower COR to be used as a filler material 26. The BBCOR limits imposed by a particular regulatory association may also dictate the dimensions of the indented region 22, as well as the specific filler material 26 used.

Providing an indented region 22 in the bat barrel 14, as opposed to thickening a substantial portion of the barrel, produces a relatively lightweight bat with a reduced BBCOR relative to similar bats that do not include an inwardly projecting rib 24. In some embodiments, heavier, less expensive filler materials 26 may alternatively be used to reduce the BBCOR of the barrel 14, while providing a ball bat that is less expensive to construct. These materials may include epoxy, sheet molding compound ("SMC"), bulk molding compound ("BMC"), syntactic foam, leather, or other suitable materials.

Figure 3:
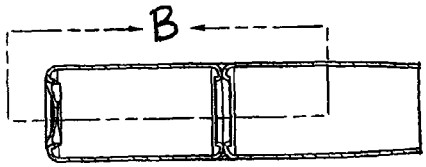
FIG. 3 is a side-sectional view of a bat barrel, according to another embodiment.
Figure 3A:
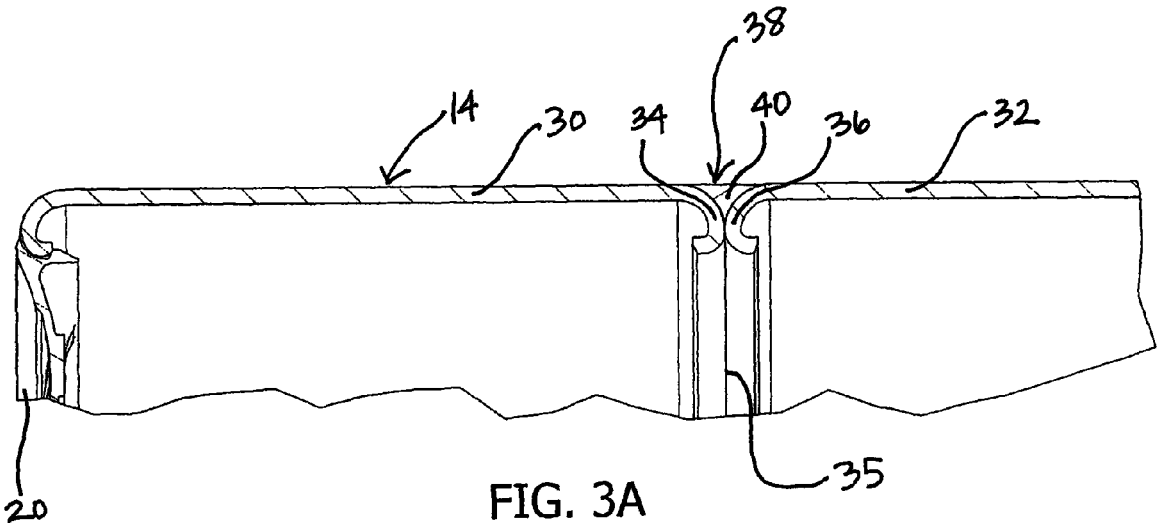
FIG. 3A is a magnified view of Section B of FIG. 3.

As shown in FIGS. 3 and 3A, in another embodiment, the barrel 14 includes a first barrel section 30 and a second barrel section 32. An interior end of the first barrel section 30 is rolled or otherwise formed into an inwardly projecting first lip 34, while an adjacent interior end of the second barrel section 32 is rolled or otherwise formed into an inwardly projecting second lip 36. In the embodiment shown in FIGS. 3 and 3A, the lips 34, 36 are curved but they could be substantially straight in other embodiments.

The two lips 34, 36 are preferably welded, bonded, or otherwise suitably attached to each other to form the barrel 14. The connected lips 34, 36 form an inwardly projecting rib 35, which is preferably located at or near the sweet spot of the barrel 14. An open region 38 is provided above the curved portions of the lips 34, 36. A filler material 40 is preferably included in the open region 38 to form a continuous, flush exterior surface with longitudinally neighboring regions of the barrel 14. The filler material 40 may be any of the filler materials 26 described above, and may be provided in the open region 38 in any manner described above, with respect to the embodiment illustrated in FIGS. 2 and 2A. As a result, the BBCOR of the barrel 14 may be reduced in a manner similar to that described above.

In an alternative embodiment (not shown), one of the first and second barrel sections may include a lip, while the other barrel section may be a cylindrical "barrel-shaped" tube. The cylindrical tube may be welded, bonded, or otherwise suitably connected to the lip, such that only one inwardly projecting lip is present. If any open space is provided above the lip, a filler material, such as any of the filler materials 26 described above, may be used to fill the open space. Such a barrel may be desirable, for example, if its BBCOR does not need to be reduced to the same extent as a barrel having two inwardly projecting lips.

Figure 4:
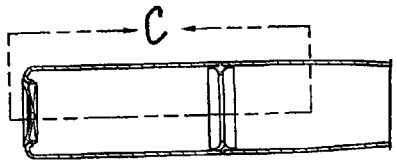
FIG. 4 is a side-sectional view of a bat barrel, according to another embodiment.
Figure 4A:
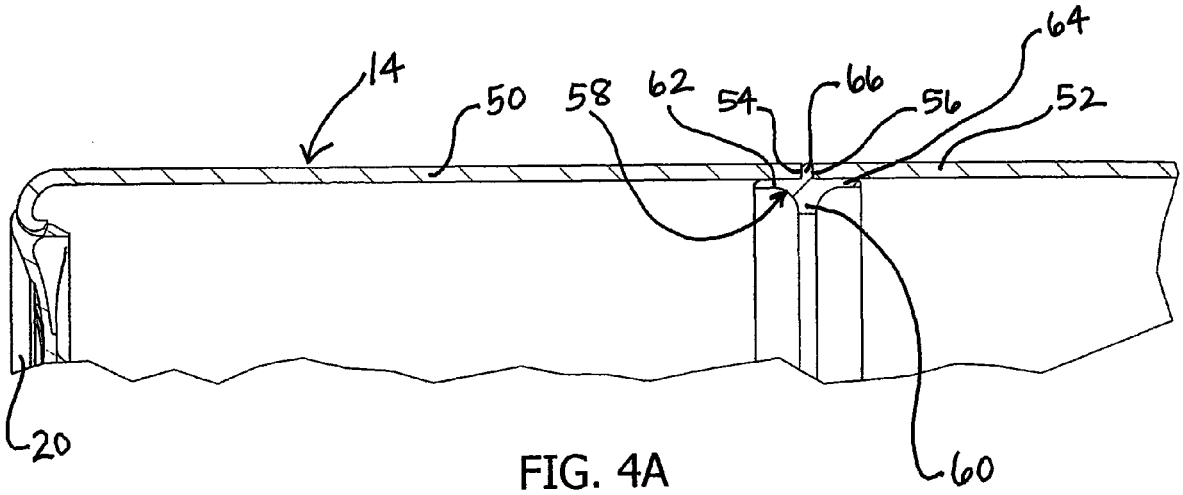
FIG. 4A is a magnified view of Section C of FIG. 4.

As shown in FIGS. 4 and 4A, in another embodiment, the barrel 14 includes a first barrel section 50 and a second barrel section 52. An interior end 54 of the first barrel section 50 is attached to an interior end 56 of the second barrel section 53 via a joint 58. The joint may be made of a metal, such as aluminum or steel, or of a composite material, or of any other suitable structural material.

The joint 58 includes an inwardly projecting member 60 that acts as a stiffening rib for reducing the BBCOR of the barrel 14. Accordingly, the joint 58 is preferably located at or near the sweet spot of the barrel 14. In one embodiment, the joint 58 includes a first mating surface 62 and a second mating surface 64 to which the first and second barrel sections 50, 52, respectively, are welded, bonded, or otherwise suitably attached. The joint 58 optionally further includes an upwardly projecting member 66 to which the first and second barrel sections 50, 52 may optionally be welded, bonded, or otherwise suitably attached. Regardless of whether the joint 58 includes such an upwardly projecting member 66, the external surfaces of the first and second barrel sections 50, 52 (and of the upwardly projecting member 66, if it is included) are preferably continuous and flush with each other. Alternative joint configurations may be used, as long as the joint includes an inwardly projecting member or portion that stiffens the barrel and reduces the BBCOR of the barrel.

Forming one or more integral ribs or other stiffeners in the barrel 14, as opposed to significantly thickening a substantial portion of the barrel 14, provides a significant reduction in BBCOR without a substantial increase in the bat's MOI. Surprisingly, inclusion of a rib or stiffener at a single barrel location can appreciably reduce BBCOR along a substantial length of the bat barrel. Of course, if desired, additional ribs or stiffeners may be included in the barrel. Including multiple ribs or stiffeners, for example, allows a bat designer to selectively stiffen a variety of barrel locations (or other bat locations).

In the embodiments described herein, the integral ribs or stiffeners are generally described as being located at or near the sweet spot of the barrel 14. In some embodiments, it may be desirable to locate a rib or stiffener closer to the bat handle 12 to reduce the effect on the bat's MOI. Since the MOI is related to the square of the pivot distance, moving any added mass closer to the batter's hands considerably lowers the bat's MOI. While doing so may necessitate an "over-reduction" in BBCOR at the location of the rib or stiffener (since the sweet spot will still need to be brought within association performance limits, and a lesser reduction in BBCOR generally occurs at locations spaced from the rib or stiffener), the tradeoff in substantially reduced MOI may be preferred for certain bats or batters.

In an alternative embodiment, a ring or band of a high modulus material, such as titanium, steel, or magnesium, may be slipped or formed over the outer diameter of a barrel wall to provide increased barrel rigidity. The edges of the ring or band may be chamfered to merge with longitudinally neighboring regions in the ball bat, or seams may be included to provide smooth transitions between the edges of the ring or band and the longitudinally neighboring regions in the ball bat. As with the ribs and stiffeners described above, the ring or band may be provided at the sweet spot of the barrel or at any other barrel region (in which case over-corrections may be required at the location of the ring or band).

Any of the above-described embodiments may be used alone or in combination with one another. Furthermore, the ball bat may include additional features not described herein. While several embodiments have been shown and described, various changes and substitutions may of course be made, without departing from the spirit and scope of the invention. The invention, therefore, should not be limited, except by the following claims and their equivalents.

What is claimed is:

1. A ball bat, comprising:

a barrel including a first barrel section and a second barrel section, wherein the first section and the second section are arranged longitudinally relative to each other, such that neither of the first and second barrel sections is contained within the other, to define a hollow interior region;

wherein an end of the first barrel section comprises a first lip projecting inwardly into the interior region, and a first end of the second barrel section comprises a second lip projecting inwardly into the interior region, wherein the second lip is attached directly to the first lip at a sweet spot of the barrel; and a handle attached to or integral with a second end of the second barrel section.

2. The ball bat of claim 1 wherein the first lip is bonded or welded to the second lip.

3. The ball bat of claim 1 wherein a region above the attachment location of the first and second lips includes a filler material having an external surface that is continuous and flush with longitudinally neighboring external regions of the first and second barrel sections.

4. The ball bat of claim 3 wherein the filler material comprises a thermoplastic material.

5. The ball bat of claim 4 wherein the filler material comprises Surlyn® or thermoplastic polyurethane.

6. A ball bat, comprising:

a barrel including a first barrel section and a second barrel section arranged longitudinally relative to each other, such that neither of the first and second barrel sections is contained within the other, to define a hollow interior region;

a joint connecting the first barrel section to the second barrel section at a sweet spot of the barrel, wherein the joint includes a stiffening member projecting inwardly into the interior region; and a handle attached to or integral with the second barrel section.

7. The ball bat of claim 6 wherein the joint includes first and second mating surfaces to which the first and second barrel sections, respectively, are attached.

8. The ball bat of claim 7 wherein the first and second mating surfaces are welded or bonded to the first and second barrel sections, respectively.

9. The ball bat of claim 6 wherein external surfaces of the first and second barrel sections are continuous and flush with each other.

* * * * *